US010711977B2

(12) United States Patent
Kozuka et al.

(10) Patent No.: US 10,711,977 B2
(45) Date of Patent: Jul. 14, 2020

(54) DISPLAY SWITCHING DEVICE

(71) Applicant: KABUSHIKI KAISHA TOKAI RIKA DENKI SEISAKUSHO, Aichi (JP)

(72) Inventors: Masato Kozuka, Aichi (JP); Mitsuru Naruse, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 246 days.

(21) Appl. No.: 15/944,276

(22) Filed: Apr. 3, 2018

(65) Prior Publication Data

US 2018/0306408 A1 Oct. 25, 2018

(30) Foreign Application Priority Data

Apr. 24, 2017 (JP) ..... 2017-085436

(51) Int. Cl.

| | |
|---|---|
| ***F21V 9/14*** | (2006.01) |
| ***G09F 13/08*** | (2006.01) |
| ***G09F 13/04*** | (2006.01) |
| *G09F 13/22* | (2006.01) |

(52) U.S. Cl.

CPC ..... *F21V 9/14* (2013.01); *G09F 13/04* (2013.01); *G09F 13/08* (2013.01); *G09F 2013/222* (2013.01)

(58) Field of Classification Search

CPC . F21V 9/14; G09F 13/08; G09F 13/04; G09F 2013/222

See application file for complete search history.

(56) References Cited

U.S. PATENT DOCUMENTS 7,268,841 B2 * 9/2007 Kasajima ..... G02F 1/133536 349/115

FOREIGN PATENT DOCUMENTS

JP 61-25002 Y2 7/1986

* cited by examiner

*Primary Examiner* — Evan P Dzierzynski

(74) *Attorney, Agent, or Firm* — Roberts Calderon Safran & Cole P.C.

(57) ABSTRACT

A display switching device includes a light source emitting light having a first polarization direction and light having a second polarization direction different from the first polarization direction, a first polarizing plate having a first display region configured to transmit light in the first polarization direction and display a first display mark, and a second polarizing plate having a second display region configured to transmit light in the second polarization direction and display a second display mark. The second polarizing plate is arranged such that the first display region at least partially overlaps with the second display region. At least a part of one of the first display region and the second display region includes a mixed part in which a polarization part with a polarizing function and a non-polarization part without any polarizing function are mixed.

3 Claims, 7 Drawing Sheets

(CROSS SECTION CUT ALONG LINE A-A)

DISPLAY SWITCHING DEVICE

The present application is based on Japanese patent application No. 2017-085436 filed on Apr. 24, 2017, the entire contents of which are incorporated herein by reference.

BACKGROUND OF THE INVENTION

1. Field of the Invention

This invention relates to a display switching device.

2. Description of the Related Art

A display switching device is known which is provided with two light sources emitting light having different polarization directions each other and arranged at a case separated by a partition, two polarizing plates configured to transmit each light in the polarization directions emitted from each light source, and an information presenting plate formed with polarizing plates having respective polarization directions of light transmitting through respective polarizing plates to form displayed figures as presented information, wherein the presented information is switched by switching the emitted light (see e.g., JP S61/25002 Y2).

According to JP S61/25002 Y2, since the display switch device is configured to switch different figures etc., it has only to have a small display surface and a clear display can be obtained by a simpler construction than a known display switching device for the same use.

SUMMARY OF THE INVENTION

The display switching device disclosed by JP S61/25002 Y2 is configured such that transmittance is higher in a part where the displayed figures are overlapped in two polarizing plates and, therefore, the transmittance difference between the overlapped part and a part except the overlapped part may be increased. Thus, a problem may arise that unevenness in brightness is caused in the displayed figures.

It is an object of the invention to provide a display switching device that can prevent the unevenness in brightness to have an excellent display performance.

According to an embodiment of the invention, a display switching device comprises:

a light source emitting light having a first polarization direction and light having a second polarization direction different from the first polarization direction;

a first polarizing plate having a first display region configured to transmit light in the first polarization direction and display a first display mark; and a second polarizing plate having a second display region configured to transmit light in the second polarization direction and display a second display mark, wherein the second polarizing plate is arranged such that the first display region at least partially overlaps with the second display region, and wherein at least a part of one of the first display region and the second display region comprises a mixed part in which a polarization part with a polarizing function and a non-polarization part without any polarizing function are mixed.

Effects of the Invention

According to an embodiment of the invention, a display switching device can be provided that can prevent the unevenness in brightness to have an excellent display performance.

BRIEF DESCRIPTION OF THE DRAWINGS

Next, the present invention will be explained in conjunction with appended drawings, wherein.

DETAILED DESCRIPTION OF THE PREFERRED EMBODIMENTS

Summary of the Invention

A display switching device according to the embodiment comprises: a light source emitting light having a first polarization direction and light having a second polarization direction different from the first polarization direction; a first polarizing plate having a first display region configured to transmit light in the first polarization direction and display a first display mark; and a second polarizing plate having a second display region configured to transmit light in the second polarization direction and display a second display mark, which is provided such that at least the first display region partially overlaps the second display region. A mixed part in which a polarization part having a polarizing function and a non-polarization part losing the polarizing function are mixed is formed in at least a part of at least any one of the first display region and the second display region.

The display performance of the above display switching device can be improved compared to a display switching device without the mixed part formed in both the first display region and the second display region.

Specifically, according to the display switching device of the embodiment, a difference between transmittance in a part where the respective mixed parts of the first display mark and the second display mark are formed, and transmittance in the first display mark except the part where the mixed part is formed when the first display mark is displayed (or transmittance in the second display region except the part where the mixed part is formed when the second display mark is displayed) is reduced. Thus, uneven brightness in the display mark is suppressed when the first display mark or the second display mark is displayed. Thus, the display switching device can have an excellent display performance.

Embodiments (Summary of the Display Switching Device 1)

Figure 1A:
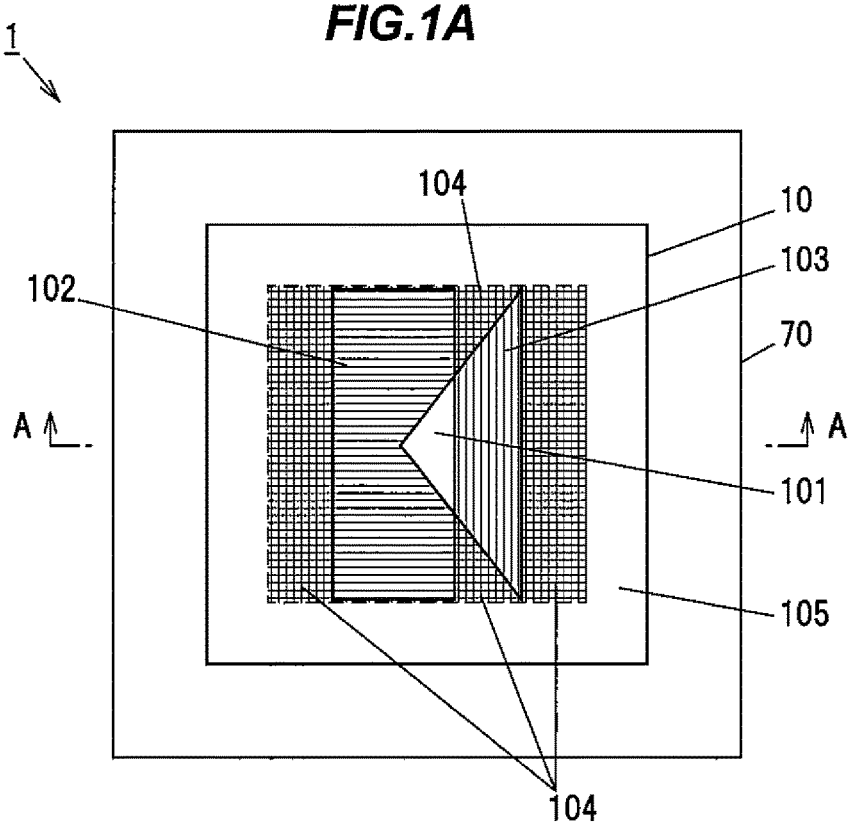
FIG. 1A is a top view showing a display switching device according to the embodiment.
Figure 1B:
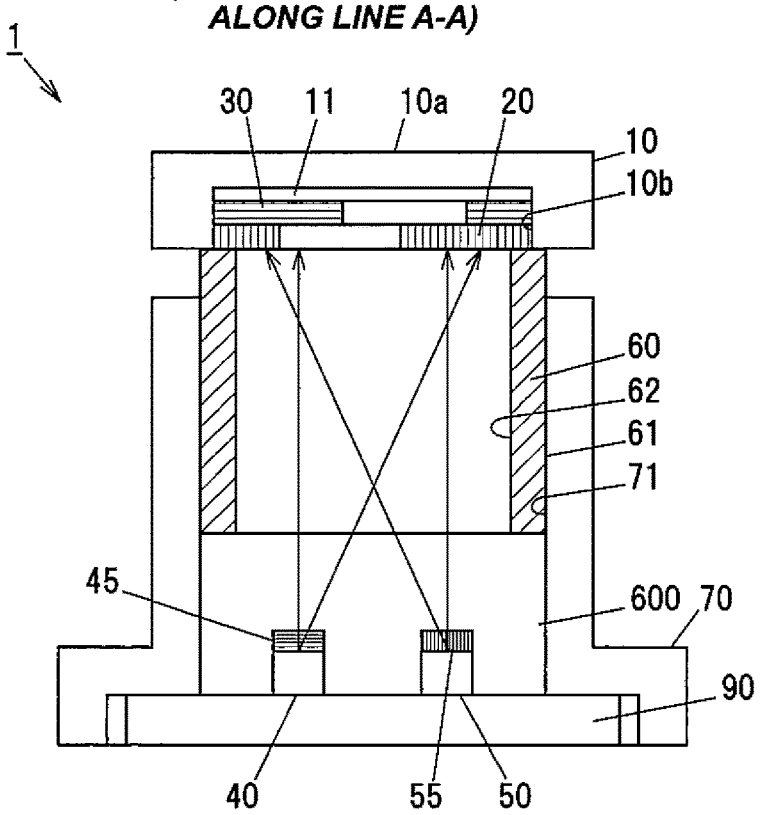
FIG. 1B is a cross sectional view showing FIG. 1A cut along the line A-A.
Figure 2A:
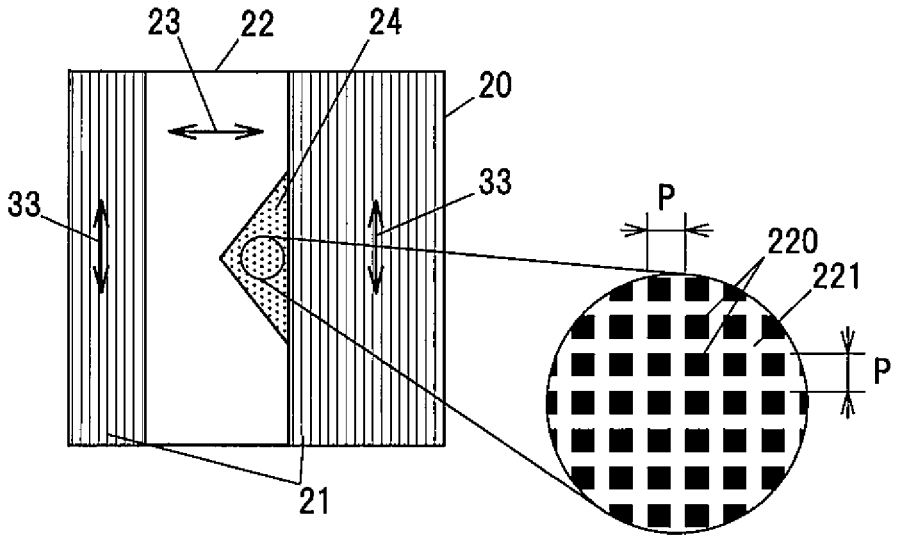
FIG. 2A is a top view showing a first display polarizing plate.
Figure 2B:
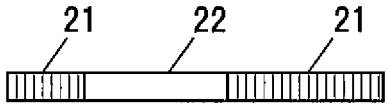
FIG. 2B is a cross sectional view showing FIG. 2A.
Figure 2C:
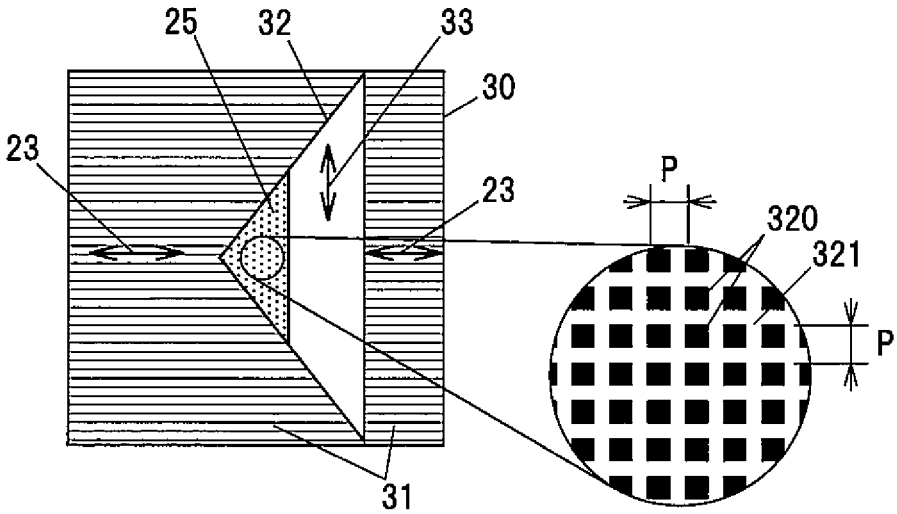
FIG. 2C is a top view showing a second display polarizing plate.
Figure 2D:
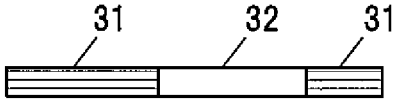
FIG. 2D is a cross sectional view showing FIG. 2C.

FIG. 1A is a top view showing a display switching device according to the embodiment. FIG. 1B is a cross sectional view showing FIG. 1A cut along the line A-A. In FIG. 1A, both first display mark and second display mark are described for the purpose of illustration. FIG. 2A is a top view showing a first display polarizing plate. FIG. 2B is a cross sectional view showing FIG. 2A. FIG. 2C is a top view showing a second display polarizing plate. FIG. 2D is a cross sectional view showing FIG. 2C.

The display switching device 1 is roughly provided with first and second light sources 40, 50, a polarizing plate for first light source 45 transmitting light in a first polarization direction 23 from light emitted from the light source 40, a polarizing plate for second light source 55 transmitting light in a second polarization direction 33 perpendicular to the first polarization direction 22, a first display polarizing plate 20 as a first polarizing plate that displays a first display mark 215, a second display polarizing plate 30 as a second polarizing plate that displays a second display mark 225, a display 10 configured to display the first and second display marks 215, 225, and a case 70 housing the first and second light sources 40, 50.

(Construction of the Display 10)

As shown in FIGS. 1A, 1B, the display 10 is provided with a display surface 10*a* of which the first and second display marks are displayed at an upper surface, and a housing 10*b* that is a concave portion housing the first and second polarizing plates 20, 30. For example, the display 10 comprises resin and the display 10 is smoked. A diffuser plate 11 scattering polarized light transmitted through the first and second polarizing plates 20, 30 toward the display surface 10*a* is attached in the housing 10 *b*.

As shown in FIG. 1A, figures such as a mark and a character are presented and displayed on the display surface 10*a* while the display region is divided into some regions. Display of figures will be described below as an embodiment of the presentation of figures.

The figures displayed on the display surface 10*a* is displayed based on emission switching control of the first light source 40 and the second light source 50 described below by combination of polarization regions and the display regions respectively formed in the first display polarizing plate 20 and the second display polarizing plate 30. As the variation, the display may be switched by generating light having the first polarization direction 23, and light having the second polarization direction 33 by using one light source and switch controlling two polarizing plates for light source. As another variation, the display may be switched by respectively generating light having the first polarization direction 23 and light having the second polarization direction 33 by using one light source and rotating one polarizing plate for light source. As the other variation, the display may be switched by arranging one or two light sources emitting light while a predetermined polarization direction is chosen.

Although the display is illuminated by uniform light through the above diffuser plate 11, the device may have no diffuser plate. The display 10 is blacked out when the display 10 is not illuminated by the first light source 40 etc., since the display 10 is smoked.

As shown in FIG. 1A, an intersectional part 101 is a region that light emitted from the first light source 40 and light emitted from the second light source 50 are transmitted through, and displayed on. The intersectional part 101 is provided such that the first display polarizing plate 20 partially overlaps the second display polarizing plate 30. The intersectional part 101 is commonly displayed with the first display mark 215 (see e.g. FIG. 3A) displayed by light emitted from the first light source 40 and the second display mark 225 (see e.g. FIG. 4A) displayed by light emitted from the second light source 50.

A first region 102 transmits only the light emitted from the first light source 40 and fails to transmit the light emitted from the second light source 50. The first region 102 is shown by hatching in the lateral direction in FIG. 1A. A second region 103 transmits only the light emitted from the second light source 50 and fails to transmit the light emitted from the first light source 40. The first region 102 is shown by hatching in the longitudinal direction in FIG. 1A. A non-display region 104 fails to transmit both the light emitted from the first light source 40 and the light emitted from the second light source 50. The non-display region 104 is shown by hatching in longitudinal and lateral directions in FIG. 1A. Meanwhile, an outer frame 105 is also a non-displayed region.

Figures such as predetermined mark and character formed by combination of the above intersectional part 101, the above first region 102, the above second region 103, and the above non-display region 104 is displayed on the display surface 10*a*. Light may transmit to indicate the predetermined figures. The transmittance is not necessary to be 100%. The imperviousness is not necessary to be 100%.

(Construction of the Case 70)

As shown in FIG. 1B, the case 70 is formed cylindrically and opened at upper end side. A substrate 90 mounting the first and second light sources 40, 50 is arranged at a bottom surface of the case 70. A cylindrical holder 60 is fixed at an inner surface of the upper end side of the case 70. An outer periphery 61 of the holder 60 is fitted in an inner periphery 71 of the case 70.

(Arrangement of the First Light Source 40)

For example, a laser beam, or an LED light can be used as the first light source 40. For example, as using the laser beam, the polarization direction is adjusted to have a polarization component in a predetermined direction, and as using the LED light etc., a polarization element is arranged at an output stage to have a polarization component in a predetermined direction. In the embodiment, the LED light source is used as the first light source 40, and the polarizing plate for first light source 45 is arranged at the output stage that is an upper side of the first light source 40.

The first light source 40 emits light vibrating in the first polarization direction 23 shown in FIG. 2A by the polarizing plate for first light source 45. That is, the polarizing plate for first light source 45 generates the light having the first polarization direction 23 from light emitted from the first light source 40.

(Arrangement of the Second Light Source 50)

For example, the laser beam, or the LED light can be used as the second light source 50. For example, as using the laser beam, the polarization direction is adjusted to have a polarization component in a predetermined direction, and as using the LED light etc., a polarization element is arranged at an output stage to have a polarization component in a predetermined direction. In the embodiment, the LED light source is used as the second light source 50, and the polarizing plate for second light source 55 is arranged at the output stage that is an upper side of the second light source 50.

The second light source 50 emits light vibrating in the second polarization direction 33 shown in FIG. 2C by the polarizing plate for second light source 55. That is, the polarizing plate for second light source 55 generates the light having the second polarization direction 33 from light emitted from the second light source 50. Thus, the polarization direction of the light emitted from the second light source 50 through the polarizing plate for second light source 55 is perpendicular to the polarization direction of the light emitted from the first light source 40 through the polarizing plate for first light source 45.

The first light source 40 emits light having the first polarization direction 23 by the polarizing plate for first light source 45. The second light source 50 emits light having the second polarization direction 33 by the second light source polarizing plate 55. That is, the light source structure in the invention is provided with the first and second light sources 40, 50, and the first and second light source polarizing plates 45, 55.

Lines in the horizontal direction added to the polarizing plate for first light source 45 and the second polarizing plate 30 shown in respective FIGS. show that only a linear polarization component vibrated in the first polarization direction 23 is transmitted. Lines in the perpendicular direction added to the polarizing plate for second light source 55 and the first polarizing plate 20 shows that only a linear polarization component vibrated in the second polarization direction 33 perpendicular to the first polarization direction 23 is transmitted.

(Construction of the First Display Polarizing Plate 20)

The first display polarizing plate 20 is formed in a tabular shape. For example, the first display polarizing plate 20 is a polarizing plate that is sandwiched with protection films respectively protecting top and bottom of a polarization layer having the polarizing function. For example, the polarization layer is a wire grid polarizing plate in which metal wire such as aluminum arranged on a resin substrate (for example, the TAC layer) in a predetermined pitch is used as the polarization element. The polarization layer is not limited to the wire grid polarizing plate. For example, the polarization layer may comprise a polyvinyl alcohol (PVA) layer. In this case, polarization property is generated by crosslinking boric acid by absorbing iodine dye, and extending the PVA layer and orienting the iodine dye after drying and stabilizing.

As shown in FIGS. 2A, 2B, the first display polarizing plate 20 is provided with a first polarization region 21 and a first display region 22.

The first polarization region 21 has the second polarization direction 33 having the polarizing function. The first polarization region 21 transmits light linear polarized in the same direction with the polarization in the second polarization direction 33. The first polarization region 21 fails to transmit light in the first polarization direction 23 that is linear polarized in the direction perpendicular to the second polarization direction 33.

The first display region 22 transmits not only the polarized light having the second polarization direction 33 but also the polarized light having the first polarization direction 23. For example, the first display region 22 is formed in a shape of the first display mark 215 shown in FIG. 3A. The shapes of first polarization region 21 and first display region 22 can display the figures such as predetermined mark and character by combining with the second display polarizing plate 30.

The first display region 22 is formed by reducing the polarization character by laser photo irradiation etc. As shown in an enlarged view of FIG. 2A, a first mixed part 24 provided with a polarization part 220 (i.e., a black part of the enlarged view of FIG. 2A) having the polarizing function to transmit only the light having the second polarization direction 33, and a non-polarization part 221 (a white space on the black background portion of the enlarged view of FIG. 2A) losing the polarizing function by laser photo irradiation etc., is formed in a triangle-formed area (an area corresponding to the intersectional part 101 shown in FIG. 1A) that is an overlapping part between the first display region 22 and the second display region 32. The first mixed part 24 is formed such that the non-polarization part 221 forms a two-dimensional lattice at a predetermined pitch P.

The non-polarization part 221 in the first mixed part 24 has no polarizing function and can transmit light without depending on a polarizing state. In such case, the predetermined pitch P is a distance between a pair of the neighboring polarization parts. For example, the pitch P is not less than 60 μm. The polarization part 220 is desirably formed such that a difference between the transmittance in the first mixed part 24 of the first display region 22 and the transmittance in the first display region except the first mixed part 24 is less than 10%. It is the same in the second display polarizing plate 30.

Figure 5:
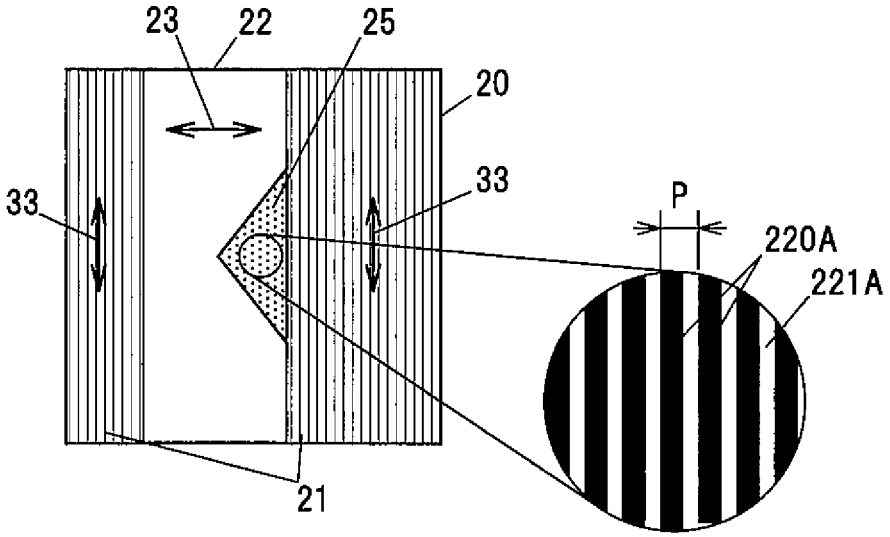
FIG. 5 is a top view showing the first display polarizing plate according to the first variation.

As the first variation, as shown in FIG. 5, the non-polarization part 221A in the first mixed part 24 of first display region 22 may form a one-dimensional strip at a predetermined pitch P. In such case, for example, the predetermined pitch P is not less than 40 μm. In the variation shown in FIG. 5, although the polarization part 220A and the non-polarization part 221A are formed into a vertical line shape, it is not limited to thereof. For example, the polarization part 220A and the non-polarization part 221A may be formed in a horizontal line.

(Construction of the Second Display Polarizing Plate 30)

The second display polarizing plate 30 is also formed in a tabular shape as with the structure of the first display polarizing plate 20. The second display polarizing plate 30 is provided such that the second display polarizing plate 30 is partially overlapped with the first display polarizing plate 20 in the display 10. The second display polarizing plate 30 is configured to emit light having the second polarization direction 33 different from the first polarization direction 23. In such case, the first polarization direction is perpendicular to the second polarization direction 33.

As shown in FIGS. 2C, 2D, the second display polarizing plate 30 is provided with a second polarization region 31 and a second display region 32.

The second polarization region 31 has the first polarization direction 23 having the polarizing function. The second polarization region 31 transmits light linear polarized in the same direction with the polarized light in the first polarization direction 23. The second polarization region 31 fails to transmit light in the second polarization direction 33 that is linear polarized in the direction perpendicular to the first polarization direction 23.

The second display region 32 transmits not only the polarized light having the first polarization direction 23 but also the polarized light having the second polarization direction 33. For example, the second display region 32 is formed in a shape of the second display mark 225 shown in FIG. 4A. The shapes of second polarization region 31 and second display region 32 can display the figures such as predetermined mark and character by combining with the first display polarizing plate 20.

The second display region 32 is formed by reducing the polarization character by laser photo irradiation etc. As shown in an enlarged view of FIG. 2C, a second mixed part 25 provided with a polarization part 320 having the polarizing function to transmit only the light having the first polarization direction 23, and a non-polarization part 321 losing the polarizing function by laser photo irradiation etc., is formed in the triangle-formed area (the area corresponding to the intersectional part 101 shown in FIG. 1A) that is the overlapping part between the first display region 22 and the second display region 32. The second mixed part 24 is configured such that the non-polarization part 321 forms a two-dimensional lattice at a predetermined pitch P.

The non-polarization part 321 has no polarizing function and can transmit light without depending on a polarizing state. As a variation, the non-polarization part 321 may be arranged at entire second display region 32 in the predetermined pitch P. It is the same in the second display region 32 of the second display polarizing plate 30.

(Operation)

Figure 3A:
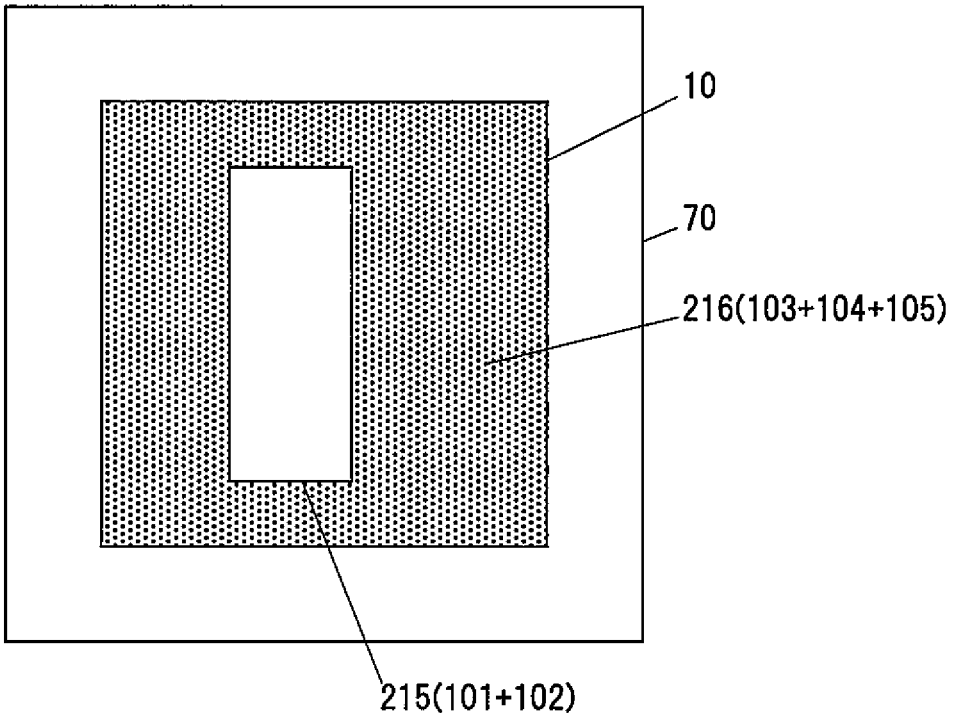
FIG. 3A is a top view showing display status of first display mark where a first light source is emitted.
Figure 3B:
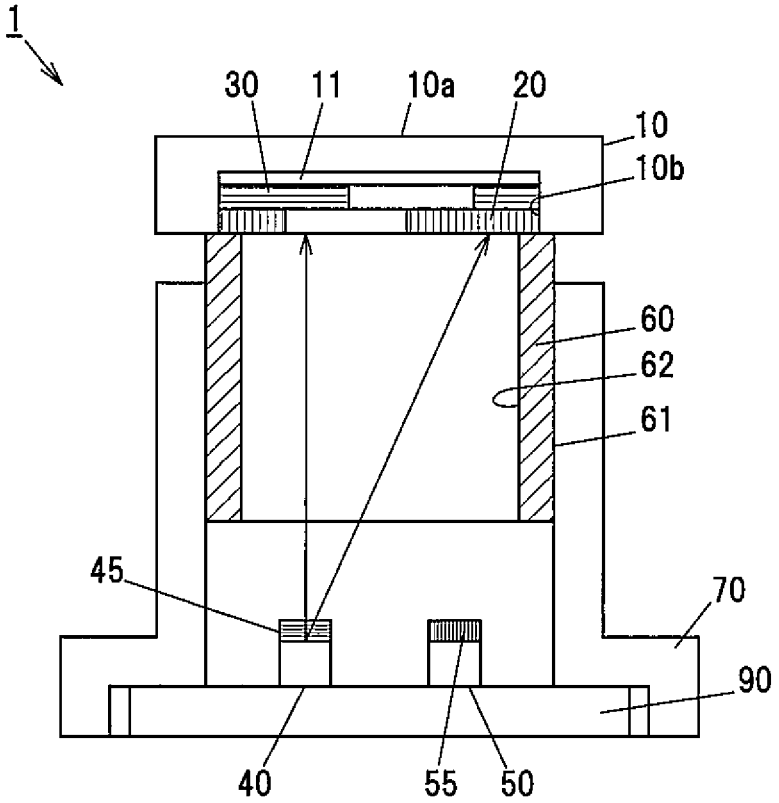
FIG. 3B is a cross sectional view showing a path of light emitted from the first light source.
Figure 4A:
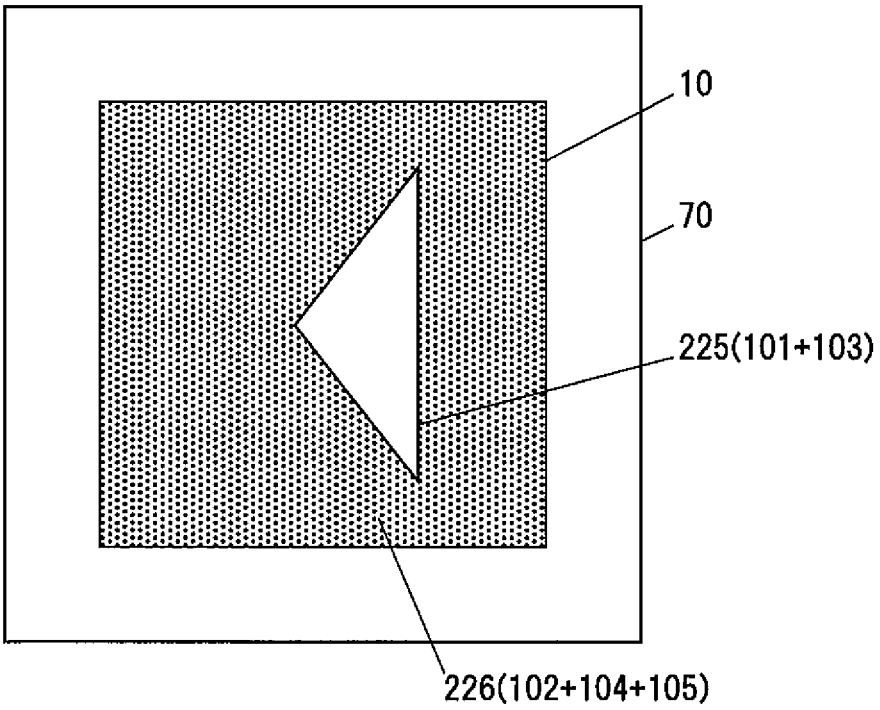
FIG. 4A is a top view showing display status of second display mark where a second light source is emitted.
Figure 4B:
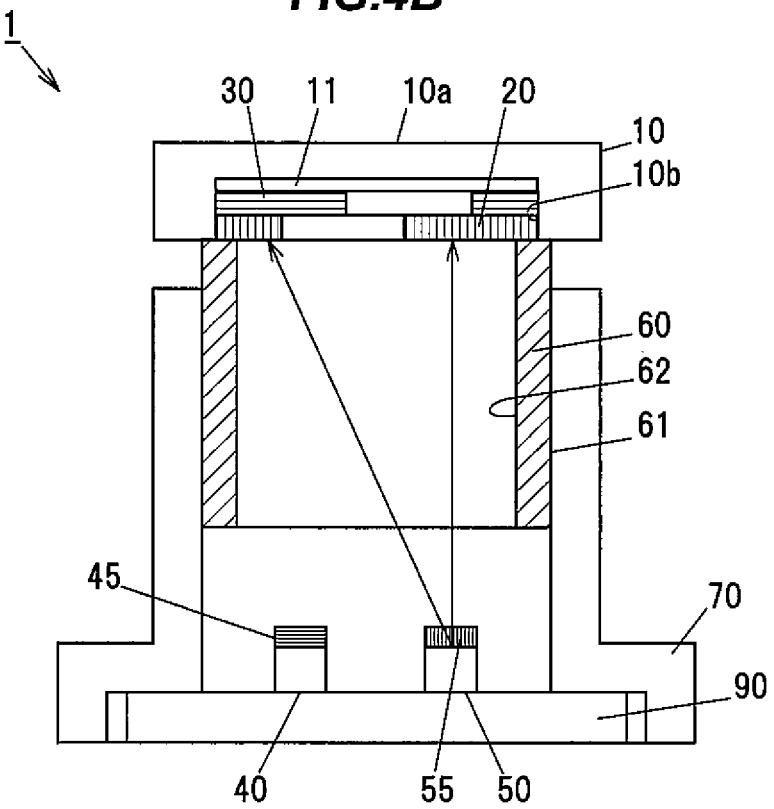
FIG. 4B is a cross sectional view showing a path of light emitted from the second light source.

FIG. 3A is a top view showing a display status of the first display mark 215 where the first light source 40 is emitted. FIG. 3B is a cross sectional view showing a path of light emitted from the first light source 40. FIG. 4A is a top view showing a display status of the second display mark 225 where the second light source 50 is emitted. FIG. 4B is a cross sectional view showing a path of light emitted from the second light source 50.

(Display of the First Display Mark 215)

As shown in FIG. 3B, when the first light source 40 is emitted, light vibrating in the first polarization direction 23 is emitted from the first light source 40 through the polarizing plate for first light source 45, and the light transmits the first display region 21 of the first display polarizing plate 20 and the second polarization region 31 of the second display polarizing plate 30. Therefore, the first display mark 215 combining the intersectional part 101 with the first region 102 shown in FIG. 1A is displayed as shown in FIG. 3A. An area except the first display mark 215 is not displayed as the non-display mark 216 combining the second region 103, the non-display region 104 and the frame part 105 as shown in FIG. 1A.

(Display of the Second Display Mark 225)

As shown in FIG. 4B, when the second light source 50 is emitted, light vibrating in the second polarization direction 33 is emitted from the second light source 50 through the polarizing plate for second light source 55, and the light transmits the first polarization region 21 of the first display polarizing plate 20 and the second display region 32 of the second display polarizing plate 30. Therefore, the second display mark 225 combining the intersectional part 101 with the second region 103 shown in FIG. 1A is displayed as shown in FIG. 4A. An area except the second display mark 225 is not displayed as the non-display mark 216 combining the first region 102, the non-display region 104, with the frame part 105 shown in FIG. 1A.

Although the movement of the display switching device 1 is described in FIGS. 3A to 4B, in the display switching device described in PTL.1, it is a problem to cause uneven brightness caused by unevenness of transmittance in a display mark since the transmittance in an overlapping part between two display marks is higher than the transmittance in an area except the overlapping part.

Specifically, when the first display region and the second display region are not provided with the polarization parts 220, 320 in respective display regions, for example, uneven brightness may be caused in the first display mark 215 since transmittance in the overlapping part between the first display mark 215 and the second display mark 225 (the overlapping part between the first display region 22 and the second display region 32) is higher than transmittance in an area except the overlapping part (corresponding to the first region 102 in FIG. 1A) in the first display mark 215. It is in the same where the second display mark 225 is displayed.

Meanwhile, according to the embodiment, since the first mixed part 24 in the first display region 22 and the second mixed part 25 of the second display region 32 is respectively provided with the polarization parts 220, 320 having the polarizing function, the difference between transmittance in the overlapping part between the first display mark 215 and the second display mark 225, and a part except the overlapping part in the display marks can be reduced compared to the construction without the polarization parts 220, 320. Thus, uneven brightness in the display marks can be suppressed so as to improve the display performance.

Effects of the Embodiment

As described above, the display switching device 1 according to the embodiment can reduce the difference between the transmittance in the overlapping part (i.e., the part corresponding to the first and second mixed parts 24, 25) between the first display region 22 and the second display region 32, and the transmittance in the part except the overlapping part where the first display mark 215 is displayed since the polarization parts 220 having the polarizing function is formed at the predetermined pitch P in the first and second display regions 22, 32 of the polarizing plates for first and second display marks 20, 30. Thus, the display switching device 1 having high display performance can be provided by controlling uneven brightness in the first display mark 215 (i.e., the region corresponding to the intersectional part 101 and the first region 102 in FIG. 1A) compared to a case that the first and second mixed parts 24, 25 are respectively formed in the first display region 22 and the second display region 32. It is in the same where the second display mark 225 is displayed.

Although the embodiments and the variations of the invention have been described, the embodiments and the variations are just examples and the invention according to claims is not to be limited to the above-mentioned embodiment and the above-mentioned variations.

Figure 6A:
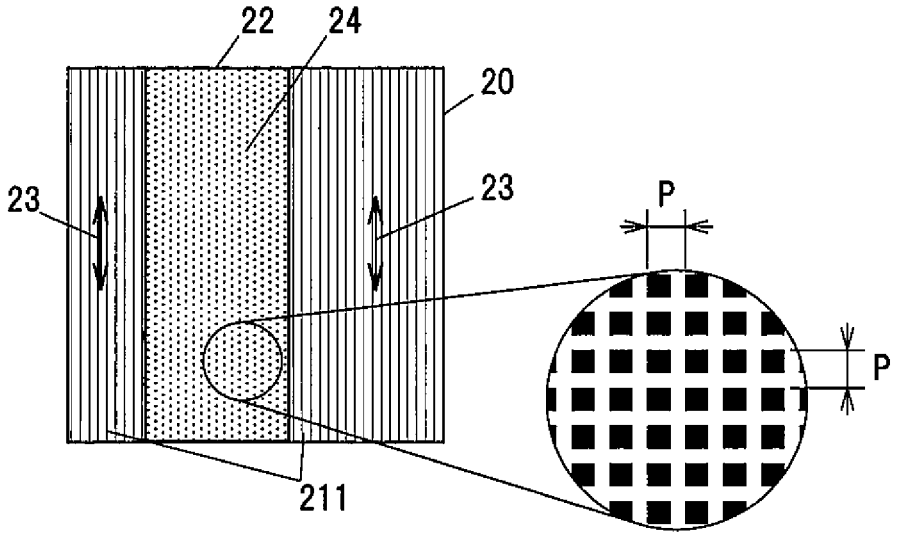
FIG. 6A is a top view showing the first display polarizing plate according to the second variation.
Figure 6B:
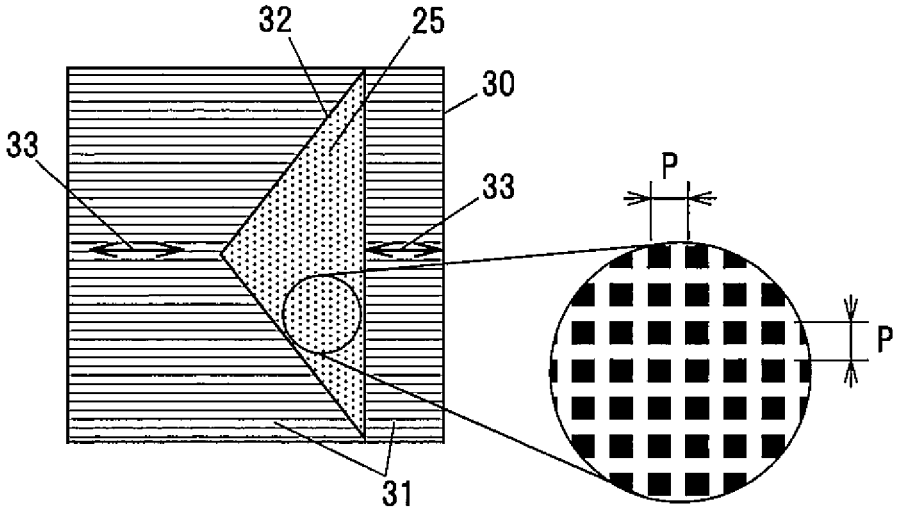
FIG. 6B is a top view showing the second display polarizing plate according to the second variation.

For example, in the above embodiment, although the first and second mixed parts 24, 25 of polarizing plates for the first display mark 20 and the second display mark 30 are respectively formed in only the overlapping part between the first display region 22 and the second display region 32, it is not limited to thereof. As shown in FIGS. 6A, 6B, for example, as the second variation, the first mixed part 24 may be formed in entire first display region 22, and the second mixed part 25 may be formed in entire second display region 32.

According to the above construction, when the first display mark 215 is displayed, the display switching device 1 according to the embodiment can reduce the difference between the transmittance in the overlapping part (i.e., the part corresponding to the first and second mixed parts 24, 25) between the first display region 22 and the second display region 32 and the transmittance in the part except the overlapping part, as compared to a case that the first mixed part 24 and the second mixed part 25 are not completely formed in the first display region 22 and the second display region 32. That is, this construction can also offer the same effect as the above embodiment.

In the above embodiment, in the respective first and second display regions 22, 32, although the regions except the first and second mixed part 24, 25 fail to have the polarizing function to transmit both polarized lights in the first and second polarization directions 23, 33 (white-out areas in FIGS. 2A, 2C), it is not limited to thereof. The regions except the first and second mixed part 24, 25 may have the polarizing function respectively.

Figure 7A:
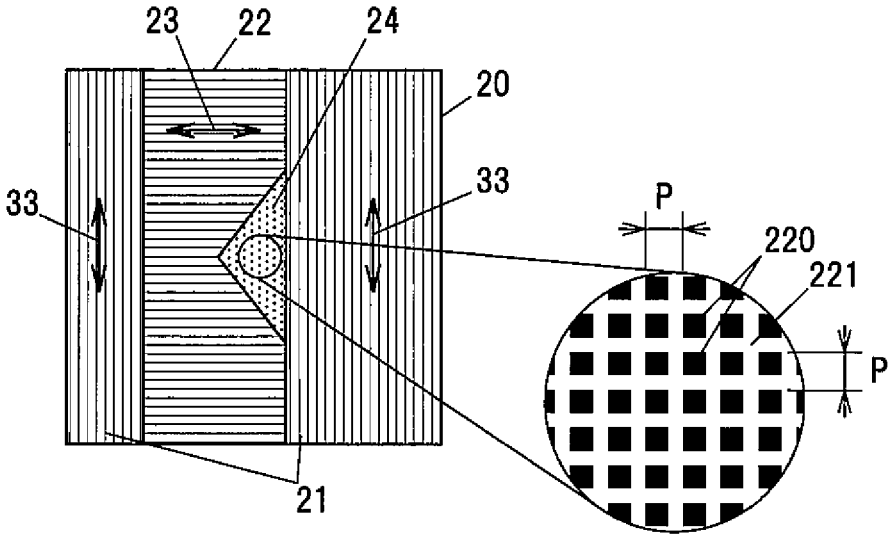
FIG. 7A is a top view showing the first display polarizing plate according to the third variation.
Figure 7B:
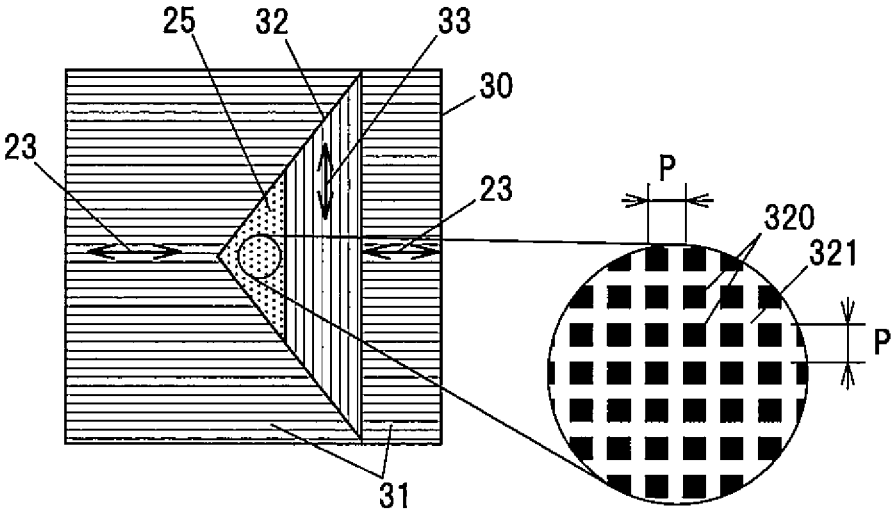
FIG. 7B is a top view showing the second display polarizing plate according to the third variation.

For example, as the third variation, as shown in FIG. 7A, a region except the first mixed part 24 from the first display region 22 may be a polarizing part (i.e., a part with horizontal lines) having the first polarization direction 23. Similarly, as shown in FIG. 7B, a region except the second mixed part 25 from the second display region 32 may be a polarizing region (i.e., a part with vertical lines) having the second polarization direction 33. These constructions can also offer the same effect as the above embodiment.

In the above embodiment, although a case that the mixed parts are formed in both the first display polarizing plate 20 and the second display polarizing plate 30, it is not limited to thereof. The mixed part combining a polarization part having the polarizing function and a non-polarization part losing the polarizing function may be formed in at least one of the polarizing plates from the first display polarizing plate 20 and the second display polarizing plate 30. That is, the mixed part may be formed in at least one region of the first display region 22 and the second display region 32. Thus, uneven brightness in the display marks can be also suppressed.

The novel embodiment and novel variation can embodied in a variety of other embodiment, the various kinds of modifications, omissions, substitutions, and changes can be implemented without departing from the gist of the invention. It should be noted that all combinations of the features described in the embodiments are not necessary to solve the problem of the invention. The accompanying claims and their equivalents are intended to cover such forms of modifications as would fall within the scope and the gist of the inventions.

What is claimed is:

1. A display switching device, comprising:

a light source emitting light having a first polarization direction and light having a second polarization direction different from the first polarization direction;

a first polarizing plate having a first display region configured to transmit light in the first polarization direction and display a first display mark; and a second polarizing plate having a second display region configured to transmit light in the second polarization direction and display a second display mark, wherein the second polarizing plate is arranged such that the first display region at least partially overlaps with the second display region, wherein at least a part of one of the first display region and the second display region comprises a mixed part in which a polarization part with a polarizing function and a non-polarization part without any polarizing function are mixed, wherein the polarization part in the mixed part is formed at a predetermined pitch, and wherein the non-polarization part in the mixed part is formed into a one dimensional strip shape at the predetermined pitch.

2. A display switching device, comprising:

a light source emitting light having a first polarization direction and light having a second polarization direction different from the first polarization direction;

a first polarizing plate having a first display region configured to transmit light in the first polarization direction and display a first display mark; and a second polarizing plate having a second display region configured to transmit light in the second polarization direction and display a second display mark, wherein the second polarizing plate is arranged such that the first display region at least partially overlaps with the second display region, wherein at least a part of one of the first display region and the second display region comprises a mixed part in which a polarization part with a polarizing function and a non-polarization part without any polarizing function are mixed, wherein the polarization part in the mixed part is formed at a predetermined pitch, and wherein the non-polarization part in the mixed part is formed into a two dimensional lattice shape at the predetermined pitch.

3. A display switching device, comprising:

a light source emitting light having a first polarization direction and light having a second polarization direction different from the first polarization direction;

a first polarizing plate having a first display region configured to transmit light in the first polarization direction and display a first display mark; and a second polarizing plate having a second display region configured to transmit light in the second polarization direction and display a second display mark, wherein the second polarizing plate is arranged such that the first display region at least partially overlaps with the second display region, wherein at least a part of one of the first display region and the second display region comprises a mixed part in which a polarization part with a polarizing function and a non-polarization part without any polarizing function are mixed, and wherein the first display region comprises the mixed part and a polarization part having the first polarization direction in a part except the mixed part.

* * * * *